US011879296B2

(12) United States Patent
Zhang et al.

(10) Patent No.: US 11,879,296 B2
(45) **Date of Patent: *Jan. 23, 2024**

(54) BLADE CAP FORCE MODULATION SYSTEM FOR A DRILL BIT

(71) Applicants: CNPC USA Corporation, Houston, TX (US); Beijing Huamei Inc. CNPC, Beijing (CN)

(72) Inventors: Ming Zhang, Houston, TX (US); Chris Cheng, Houston, TX (US); Jiaqing Yu, Houston, TX (US); Qi Peng, Beijing (CN); Xiaohua Ke, Beijing (CN)

(73) Assignees: CNPC USA Corporation, Houston, TX (US); Beijing Huamei, Inc. CNPC, Beijing (CN)

( * ) Notice: Subject to any disclaimer, the term of this patent is extended or adjusted under 35 U.S.C. 154(b) by 0 days.

This patent is subject to a terminal disclaimer.

(21) Appl. No.: 17/935,127

(22) Filed: Sep. 25, 2022

(65) Prior Publication Data

US 2023/0015380 A1 Jan. 19, 2023

Related U.S. Application Data

(63) Continuation of application No. 17/100,872, filed on Nov. 21, 2020, now Pat. No. 11,499,378.

(51) Int. Cl.
*E21B 10/62* (2006.01)
*E21B 10/43* (2006.01)

(52) U.S. Cl.
CPC ..... *E21B 10/62* (2013.01); *E21B 10/43* (2013.01)

(58) Field of Classification Search
CPC ..... E21B 10/62; E21B 10/43; E21B 10/46; E21B 10/00; E21B 10/627
See application file for complete search history.

(56) References Cited

U.S. PATENT DOCUMENTS

| | | | | |
|---|---|---|---|---|
| 5,678,645 | A | 10/1997 | Tibbitts et al. | |
| 9,938,814 | B2 | 4/2018 | Hay | |
| 10,494,876 | B2 | 12/2019 | Mayer et al. | |
| 2010/0212964 | A1* | 8/2010 | Beuershausen | E21B 7/064 175/57 |

(Continued)

FOREIGN PATENT DOCUMENTS

| | | | |
|---|---|---|---|
| CN | 104564064 | A | 4/2015 |
| CN | 204326973 | U | 5/2015 |

(Continued)

*Primary Examiner* — Caroline N Butcher
(74) *Attorney, Agent, or Firm* — Craft Chu PLLC; Andrew W. Chu

(57) ABSTRACT

The force modulation system for a drill bit includes a cutter, a blade cap, a cap retention device, and a first force member. The cutter or cutters fit in the blade cap, and the blade cap fits to the drill bit. The cap retention device exerts a cap retention force in a first direction. The first force member exerts a first force in a second direction. The cutting profile of the force modulation system is now variable in more than one direction so as to avoid excessive forces from more than one direction for each cutter on the blade cap. There can also be a second force member to exert a second force in the first direction for more variability of the cutting profile in the first direction and a third force member to exert a third force in an opposite second direction.

9 Claims, 3 Drawing Sheets

(56) References Cited

U.S. PATENT DOCUMENTS

| | | | | |
|---|---|---|---|---|
| 2018/0030786 | A1* | 2/2018 | Dunbar | E21B 10/42 |
| 2019/0249498 | A1* | 8/2019 | Hinz | E21B 10/633 |
| 2021/0254410 | A1* | 8/2021 | Maouche | E21B 10/43 |

FOREIGN PATENT DOCUMENTS

| | | | | |
|---|---|---|---|---|
| CN | 105604491 | B | 5/2016 | |
| CN | 105156035 | B | 3/2017 | |
| CN | 108474238 | A | 8/2018 | |
| WO | WO-2017146716 | A1 * | 8/2017 | E21B 10/14 |

* cited by examiner

BLADE CAP FORCE MODULATION SYSTEM FOR A DRILL BIT

CROSS-REFERENCE TO RELATED APPLICATIONS

The present application claims priority under 35 U.S.C. Section 120 from U.S. patent application Ser. No. 17/100,872, filed on 21 Nov. 2020, entitled "BLADE CAP FORCE MODULATION SYSTEM FOR A DRILL BIT". See also Application Data Sheet.

STATEMENT REGARDING FEDERALLY SPONSORED RESEARCH OR DEVELOPMENT

Not applicable.

THE NAMES OF PARTIES TO A JOINT RESEARCH AGREEMENT

Not applicable.

INCORPORATION-BY-REFERENCE OF MATERIAL SUBMITTED ON A COMPACT DISC OR AS A TEXT FILE VIA THE OFFICE ELECTRONIC FILING SYSTEM (EFS-WEB)

Not applicable.

STATEMENT REGARDING PRIOR DISCLOSURES BY THE INVENTOR OR A JOINT INVENTOR

Not applicable.

BACKGROUND OF THE INVENTION

1. Field of the Invention

The present invention relates to cutting elements on a drill bit. More particularly, the present invention relates to a force modulation system for fixed cutters on the drill bit. Even more particularly, the present invention relates to a force modulation system for a cutter on a blade cap.

2. Description of Related Art Including Information Disclosed Under 37 CFR 1.97 and 37 CFR 1.98

Polycrystalline diamond compact (PDC) cutters are used in drilling operations for oil and gas. Prior art drill bits include roller cone bits with multiple parts and rotating cutters to gouge and scrape through the rock formation. Rows of cutters moved along parts of the drill bit so that wear on the cutters was distributed. The multiple parts of the drill bit include the bit blade, bit body, cone, bearing and seal. Newer drill bits were fixed-head drill bits, which were composed of a single drill bit without any moving components. The cutters were fixed on either the bit blade or bit body of the drill bit. The fixed-head drill bits are rotated by the drill string, so moving parts on the drill bit were not needed. The cutters fixed to the parts of the drill bit determine the cutting profile for a drill bit and shear through the rock formation in place on the drill bit. The fixed cutters were more reliable under extreme heat and pressure conditions of the wellbore because there were no moving components. However, the wear on these cutters was substantial.

The further complication is that the wear on fixed cutters is not equal. There are regular sources of damage to all fixed cutters, like vibration and impact load. However, fixed cutters on different parts of the drill bit wear at different rates. For example, the fixed cutters in the cone do not wear at the same rate and manner as fixed cutters on the bit blade. In particular, the fixed cutters placed on the bit blade are on a side of the drill bit and have the highest linear cutting velocity that results in more severe wear and the most cutting force. The damage to all fixed cutters and the extra damage to fixed cutters on the bit blade cause premature failure of the drill bit, limit rate of penetration into the rock formation, and limit the footage drilled into the rock formation.

The prior art already discloses adjustments to the cutting profile of fixed cutters while drilling. FIG. 1 shows the prior art system with a fixed cutter 1 mounted in a holder 2. The holder 2 is mounted in the drill bit 3. There is a retention member 4 to hold the cutter 1 within the holder 2, and there is an elastic member 5 between the holder 2 and the drill bit 3. The elastic member 5 can be a spring, which compresses to lessen the cutting force against harder rock. The lesser force on the fixed cutter can prevent damage. The spring sets the upper limit of cutting force. Any higher load will cause the fixed cutter to retract. Various patents and publication disclose this mechanism of a spring that reduces the force on the fixed cutter, including CN 105604491, published on 2016 May 25 for Li, CN 204326973, published on 2015 May 13 for Ge, Huixiang et al., CN 105156035, published on 2017 Mar. 29 for Hua, Jian et al., USPub 20100212964, published on 2010 Aug. 26 for Beuershausen, U.S. patent Ser. No. 10/000,977, issued on 2018 Jun. 19 for Jain et al, U.S. Pat. No. 6,142,250, issued on 2000 Nov. 7 for Griffin et al., and U.S. Pat. No. 5,678,645, issued on 1997 Oct. 21 to Tibbitts et al. Being a fixed cutter on refers to being fixed in position on the drill bit. The fixed cutter is not completed locked in position. The fixed cutter moves toward and away from the drill bit in the one direction of the elastic member.

There have been slight modifications to the prior art system, such as the cutter with retention member directly in the drill bit without a holder. See Zongtao et al., CN 104564064, published on 2015 Apr. 29 for Liu, Zhihai et al. Different elastic members are also known in U.S. patent Ser. No. 10/494,876, issued on 2019 Dec. 3 to Mayer et al., U.S. Pat. No. 9,938,814, issued on 2018 Apr. 10 to Hay, and CN 108474238, published on 2018 Aug. 31 for Grosz, Gregory Christopher. The prior art systems remain unidirectional. The variation in force on the fixed cutter is limited to the orientation of the elastic member. The cutting profile can change only slightly as individual fixed cutters can move up and down in the one direction of the elastic member. The one dimensional variations to the cutting profile fail to effectively protect fixed cutters on the parts of the drill bit that encounter angled forces with drilling. In particular, the fixed cutters on the shoulder of the drill bit, known as shoulder cutters, encounter the junctions between different rock formations and require the most cutting force. There are forces against the fixed cutter by the rock formations in more than one dimension at these junctions. The depth of cut and the impact forces on the shoulder cutters are changing, as the rock formation is drilled at the junctions.

The force modulation systems are limited to one per cutter. There is a need to efficiently protect each fixed cutter in more than one dimension without adding so many extra components.

It is an object of the present invention to provide a force modulation system for a drill bit.

It is an object of the present invention to provide a variable cutting profile of a drill bit with fixed cutters.

It is an object of the present invention to provide a force modulation system for fixed cutters on the shoulder of the drill bit.

It is another object of the present invention to provide a multi-directional force modulation system.

It is still another object of the present invention to provide a force modulation system with variable force in a first direction and in a second direction with the second direction being offset or even orthogonal to the first direction.

It is another object of the present invention to provide a cutting profile with fixed cutters variable in two directions relative to the drill bit.

It is yet another object of the present invention to provide a cutting profile with fixed cutters variable in three directions relative to the drill bit.

It is another object of the present invention to provide a force modulation system for a drill bit with a blade cap for a cutter or plurality of cutters.

It is still another object of the present invention to provide a force modulation system for a drill bit with the blade cap as wedge with an outer perimeter for the plurality of fixed cutters.

It is yet another object of the present invention to provide a force modulation system for a drill bit with the blade cap as wedge with a pivot point and a cap retention pin attaching the wedge to the drill bit through the pivot point.

These and other objectives and advantages of the present invention will become apparent from a reading of the attached specification, drawings and claims.

BRIEF SUMMARY OF THE INVENTION

Embodiments of the force modulation system for a drill bit include a cutter, a blade cap with cap sides, a cap retention means fixed to the cap sides, and a first force member. The cutter is in removable slide fit engagement with the blade cap. The cutter extends from the blade cap so as to drill into rock formations. There can be a plurality of cutters set in one blade cap. The cap retention means sets the position of the blade cap within the drill bit. The cutter or cutters fit in the blade cap, and the blade cap fits in or to the drill bit. The cap retention means exerts a cap retention force in a first direction of the blade cap. The cap retention force maintains the position of the blade cap relative to the drill bit. In particular, the first direction is one direction of movement of the blade cap relative to the drill bit, and the cap retention means exerts the cap retention force in that first direction so as to prevent movement of the blade cap in that first direction. The movement can be radially away and towards the drill bit.

The first force member is positioned against the blade cap so as to exert a first force in a second direction of the blade cap. The first force also maintains the position of the blade cap relative to the drill bit, but in a different dimension. In particular, the second direction is another direction of movement of the blade cap relative to the drill bit. The second direction is angled offset to the first direction. The second direction can be orthogonal to the first direction. Relative to the drill bit cavity, the first direction can be vertical, and the second direction can be horizontal. The first direction can be radial, and the second direction can be tangent to the first direction. The cap retention means and the first force member are cooperative to maintain position of the blade cap in more than one dimension, i.e. in more than the first direction.

The first force in the second direction determines the cutting profile of the force modulation system. The first force member exerts a first force that is variable so that the cutters avoid damage from excessive force in the second direction. The second direction of the first force member is not the same as the first direction. The second direction is offset angled so that excessive force of a different direction than the first direction can be avoided. The force modulation system can avoid damage from excessive force from different directions.

An alternate embodiment of the force modulation system includes a second force member positioned against the blade cap so as to exert a second force in the first direction of the holder. The second force member is an additional support against excessive force in the first direction. The cap retention member can be set as a breaking point before the critical amount of excessive force that causes damage to the cutters. To protect the cap retention means from being disabled from excessive force, the second force member provides the second force in the first direction as a supplement to the cap retention force in the first direction. The cutting profile is now variable in the first direction, according to the second force member. The cutting profile of the force modulation is now determined by both the first force in the second direction and the second force in the first direction. The cutter can now avoid the damage of excessive force in the first direction AND in the second direction. The first force member can be made integral with the second force member.

Embodiments of the present invention include a third force member positioned against the blade cap so as to exert a third force in the second direction opposite to the first force. The first force member and the third force member are opposite each other to avoid excessive force back and forth in the second direction and opposite second direction. Instead of a hard stop against the drill bit, the same back and forth avoidance of excessive force from depth of cut in the first direction relative to the drill bit can be achieved with the first force member and the third force member providing a back and forth avoidance of excessive force from impacts at the junction of different rock materials in the rock formation. The first force member, the second force member, and the third force member can be made integral with each other. There is also an embodiment with the first force member and the third force member, without the second force member.

Other embodiments of the force modulation system include the blade cap as a wedge with the holding end as an outer perimeter and the cap sides as two flange portions. The anchor end can have a pivot point, so that the cap retention means is a retention pin inserted through the two flange portions. The retention pin sets the first direction as radial from the pivot point, while the second direction and the opposite second direction are tangent to the first direction. The offset angled relationship between the first direction and the second direction is orthogonal as radial and tangent. The first force member, the second force member, and the third force member can be placed against the corresponding two flange portions and outer perimeter.

DETAILED DESCRIPTION OF THE INVENTION

Figure 1:
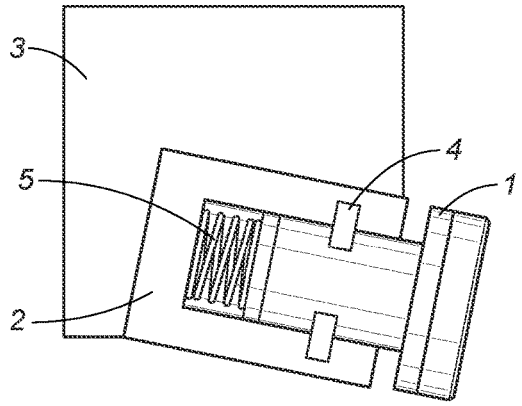
FIG. 1 Prior Art
FIG. 1 is a schematic sectional view of a prior art force modulation system.

Conventional force modulation systems are limited to one dimension and one direction. The cutter, or the cutter in a holder, moves up and down within a drill bit cavity formed to fit the cutter or holder. A spring sits at the bottom of the drill bit cavity. The spring is compressible so as to reduce the amount of force exerted on the cutter by the rock formation. The cutter maintains position within the drill bit cavity to withstand sufficient force to drill through rock, while avoiding excessive force that would damage the cutter. The in and out of the drill bit cavity direction is one dimensional, corresponding to excessive force from depth of cut of the drill bit. These force modulation systems cannot account for offset force vectors, such as those forces created on shoulder cutters at junctions between different types of rock materials in a rock formation. There can be excessive force from impact forces of the rock materials that would damage the cutter from a different direction than the one direction set by force modulation systems of the prior art.

Referring to FIGS. 2-10, the force modulation system 10 for a drill bit includes a cutter 20 or plurality of cutters 20, a blade cap 30, a cap retention means 50, and a first force member 60. Each cutter 20 is comprised of a cutter body 22 having a cutting end 24, and a cutting surface 26 made integral with the cutter body 22 at the cutting end 24. The blade cap 30 is comprised of a cap body 32 having an anchor end 34, a holding end 36 opposite the anchor end 34, a plurality of cap sides 38 between the anchor end 34 and the holding end 36, and a cap opening 40 or plurality of cap openings 40 at the holding end 36. Each cutter body 22 is in removable slide fit engagement with a corresponding cap opening 40. The cutting surface 26 extends from the respective cap opening 40 so as to drill into rock formations.

Each cutter 20 is removably engaged with the blade cap 30. The cutter 20 can be rotated within the respective cap opening 40 of the blade cap 30 so that each cutting surface 26 is adjusted relative to the respective cap opening 40. In addition to the adjustments between the blade cap 30 and the drill bit 15, the cutter 20 is rotatable for wear on the cutting surface 26 to be changed. There can be a plurality of cutters 20 in one blade cap 30. Each cutter 20 can be set in its own location and orientation relative to the blade cap 30.

Figure 2:
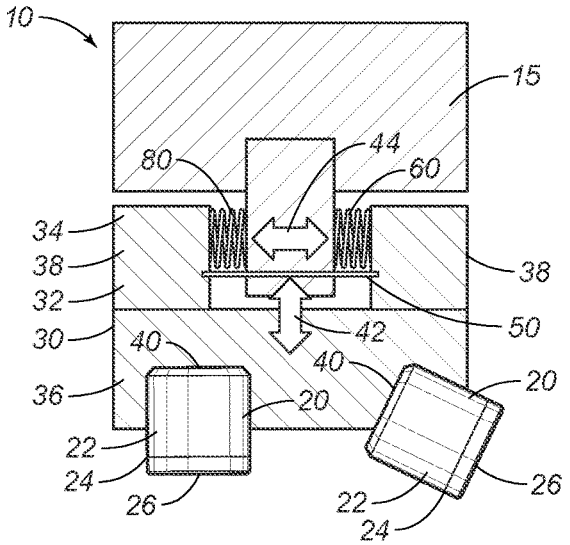
FIG. 2 is a schematic sectional view of an embodiment of the force modulation system according to an embodiment of the present invention.
Figure 3:
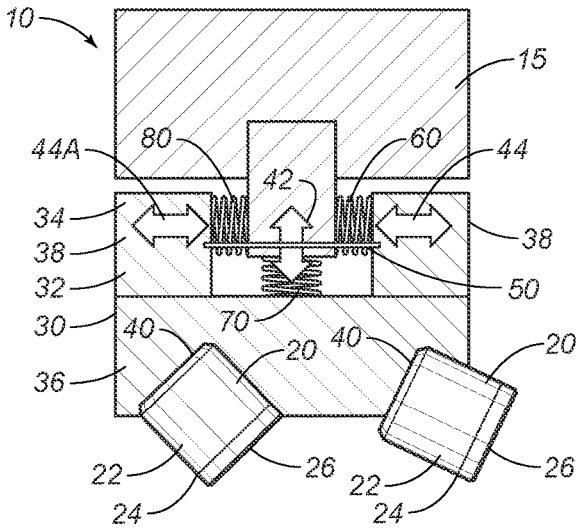
FIG. 3 is a schematic sectional view of an embodiment of the force modulation system according to another embodiment of the present invention.

The force modulation system 10 includes the cap retention means 50 fixedly engaged to at least two cap sides 38 so as to exert a cap retention force in a first direction 42 of the blade cap 30. The cap retention means 50 removable engages more than one side of the blade cap 30. FIGS. 2-3 shows the two cap sides 38 opposite each other in one embodiment. FIGS. 2 and 3 show the first direction 42 as one direction of movement of blade cap 30 relative to the drill bit. The first direction is one direction of movement of the blade cap 30 relative to the drill bit 15, and the cap retention means 50 exerts the cap retention force in that first direction so as to prevent movement of the blade cap 30 in that first direction. The movement can be radially away and towards the drill bit. The cap retention means 50 can be a snap ring, shear pin, locking ring, locking pin, retention pin as in FIGS. 6-10, slot, screw or other known mechanical device to hold position of the blade cap 30.

Figure 4:
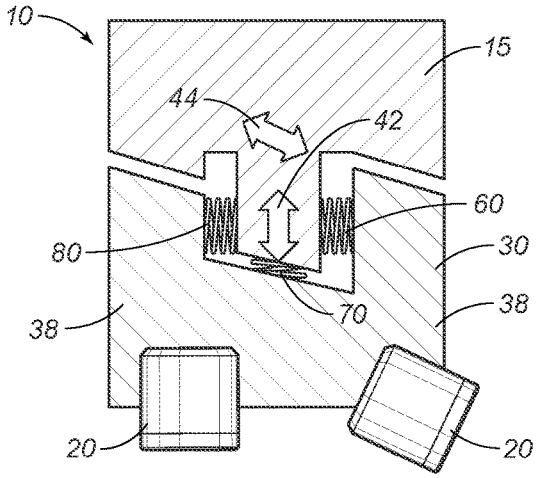
FIG. 4 is a schematic sectional view of an embodiment of the force modulation system according to still another embodiment of the present invention.
Figure 5:
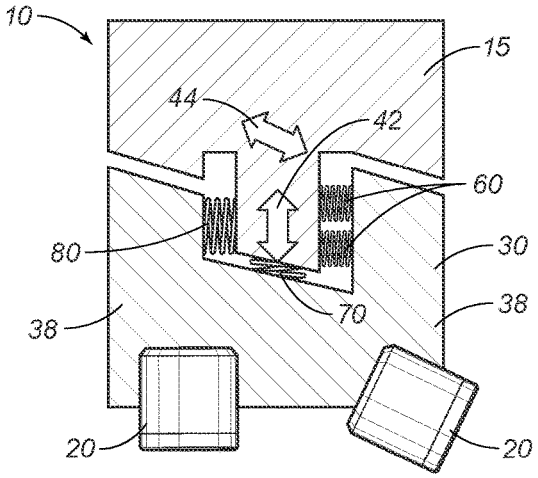
FIG. 5 is a schematic sectional view of an embodiment of the force modulation system according to yet another embodiment of the present invention.

The first force member 60 can be an elastomeric insert, a plastic insert, metal mesh, disc spring, composite elastomeric insert, metal spring, hydraulic actuator, or other known mechanical devices to exert force on the holder 30 relative to the drill bit 15. FIGS. 6-10 show the first force member 60 as an elastomeric insert, such as a rubber insert. FIGS. 2-5 show the first force member 60 as a metal spring, and FIG. 5 shows an embodiment with a plurality of metal springs 60, 60. The first force member 60 is positioned against the blade cap 30 so as to exert a first force in a second direction 44 of the blade cap 30. The second direction 44 is angled offset to the first direction 42, as shown in FIGS. 2-5. FIG. 2 shows the first direction of the blade cap 30 by the cap retention means 50, and the second direction of the blade cap 30 by the first force member 60. FIG. 2 shows the second direction 44 as orthogonal to the first direction 42. FIG. 4 shows another embodiment of the first direction 42 of the blade cap 30 by the cap retention means 50, and the second direction 44 of the blade cap 30 by the first force member 60. FIG. 4 shows the second direction 44 as offset to the first direction 42. The angle of offset can range from 60 to 120 degrees. Relative to the drill bit, FIGS. 2-3 show the first direction 42 as vertical and the second direction 44 as horizontal, wherein the offset is orthogonal. FIGS. 2-3 may also be interpreted to show an orthogonal offset with the first direction 42 as radial and the second direction 44 as tangent to the first direction.

The first direction 42 can be a direction of movement of the blade cap 30 relative to the drill bit 15, and the second direction 44 is another direction of movement of the blade cap 30 relative to the drill bit 15, including orthogonal to first direction 42. FIG. 2 shows the drill bit 15 and the dimensions of movement of the blade cap 30 relative to the drill bit 15. The cap retention force in the first direction 42 maintains position relative to the drill bit in the first direction 42. The first force in the second direction 44 determines the cutting profile of the force modulation system 10. The first force member 60 exerts a first force that is variable so that the cutters 20 avoid damage from excessive force in the second direction 44. Unlike the prior art systems, the second direction 44 of the first force member 60 is not the same as the first direction 42 for just depth of cut forces. The second direction 44 is offset angled so that excessive force of a different direction than the first direction 42 can be avoided. The cutters 20 avoid damage from impact forces from different rock materials. The first force member 60 in the position as shown is now more than just cumulative with the cap retention member 50 to help resist depth of cut force. There is a new relationship between the first force member 60 and the cap retention member 50. There is new functionality of the force modulation system 10 to avoid damage from excessive force from different angles on the cutters 20.

FIGS. 3-5 show alternate embodiments of the force modulation system 10 of the present invention with a second force member 70 positioned against the blade cap 30 so as to exert a second force in the first direction 42 of the blade cap 30. In this embodiment, the cap retention member 50 can have the cap retention force greater than the second force with both in the first direction 42. The cap retention means 50 can be set as a breaking point before a critical amount of excessive force disables the cap retention means 50. To protect the snap ring from snapping or the retention pin from fracturing, the second force member 70 provides the second force in the first direction 42 as a supplement to the cap retention force in the first direction 42. The cutting profile is now variable in the first direction 42, according to the second force member 70. The cutter 20 can avoid the damage of excessive force in the first direction 42 related to depth of cut AND in the second direction 44 in the embodiment of FIGS. 3-5 related to impact forces from the joint of different rock materials. The second force member 70 can be cumulative and cooperative with the cap retention means 50 to resist depth of cut force. The second force member 70 is not completely cumulative with the first force member 60 in the second direction 44. The second force member 70 has a different placement and relationship to the holder 30 and cutter 20.

FIG. 3 shows an embodiment with the second force member 70 completely cooperative with the cap retention means 50. The second force member 70 is aligned vertically with the cap retention means 50. FIGS. 4-5 show embodiments with the second force member 70 not completely cumulative with either the cap retention means 50 in the first direction 42 or the first force member 60 in the second direction 44. The second force in the second direction 44 is still offset from the first direction 42, but the second force only has a vector of force in the first direction 42. The second force member 70 can have a different placement and relationship to the blade cap 30 and cutter 20. FIG. 3 shows the first direction 42 as generally vertical and the second direction 44 as generally horizontal. FIGS. 4-5 are embodiments with the first direction 42 remaining generally vertical, while the second direction 44 is offset from the first direction 42 with at least of a vector of the second force in the first direction 42.

Figure 6:
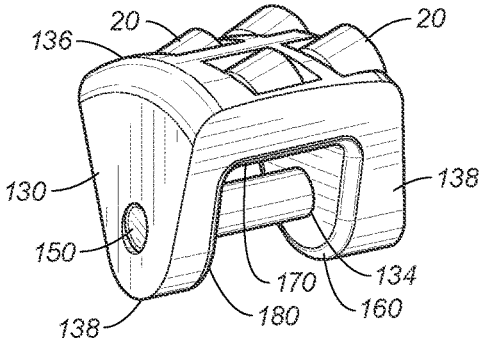
FIG. 6 is a perspective view of the embodiment of the force modulation system, according to FIG. 3.
Figure 7:
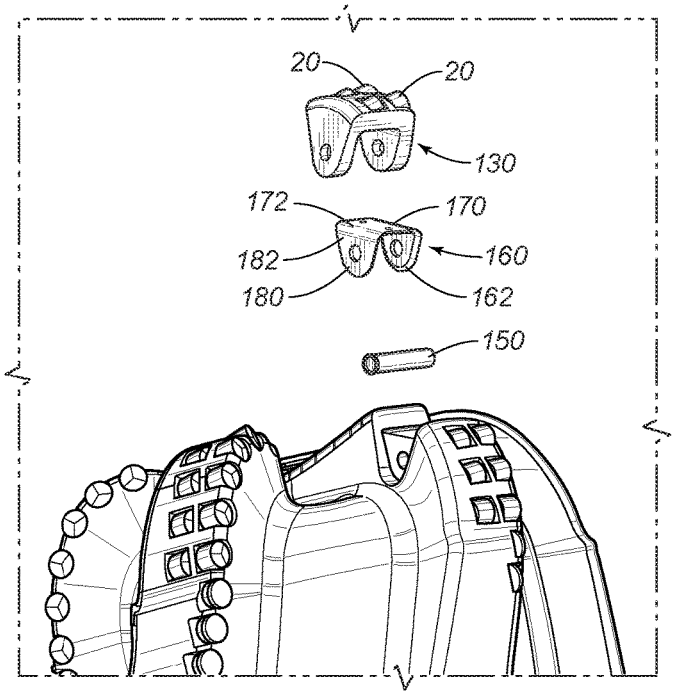
FIG. 7 is an exploded perspective view of the embodiment of the force modulation system of FIG. 3 and FIG. 6 in a drill bit.
Figure 8:
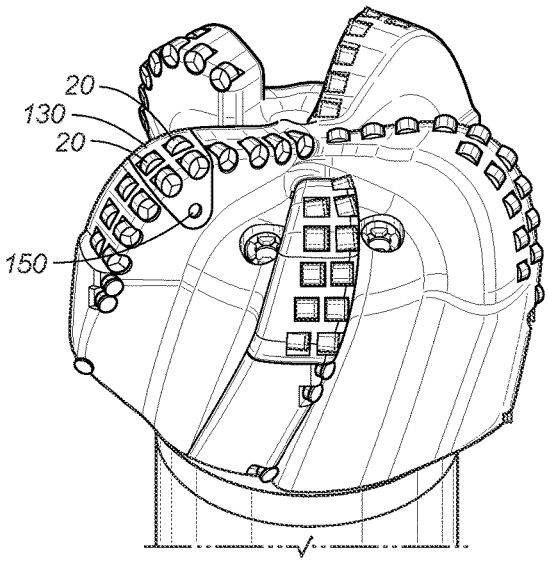
FIG. 8 is a front perspective view of the embodiment of the assembled force modulation system of FIG. 7.
Figure 9:
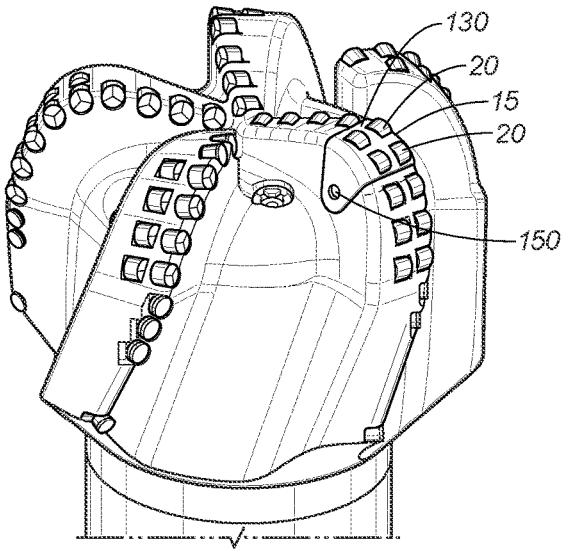
FIG. 9 is a back perspective view of the embodiment of the assembled force modulation system of FIG. 7.
Figure 10:
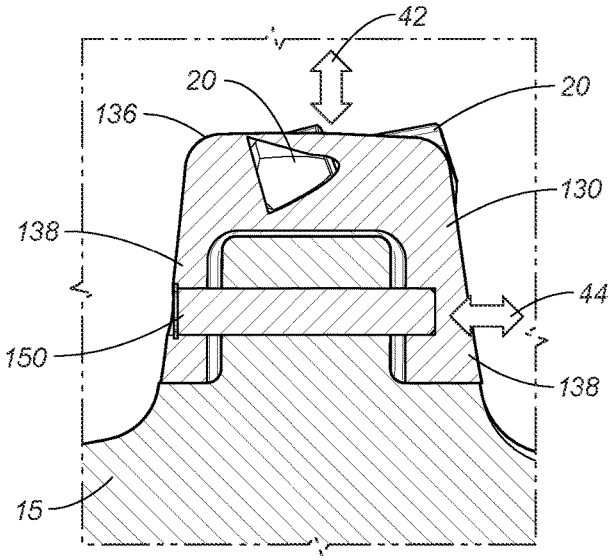
FIG. 10 is a sectional view of the embodiment of the assembled force modulation system of FIG. 7.

FIGS. 6-10 show embodiments of the first force member 160 as being made integral with the second force member 170. As a rubber insert, there can be a first spring portion 162 and a second spring portion 172 with a hinge portion 180 between the first spring portion 162 and the second spring portion 172. The offset angled relationship as orthogonal for the first direction 42 and second direction 44 are also shown in FIGS. 3, 7, and 10, even with the first force member 160 and the second force member 170 being unitary.

FIGS. 2-5 also show the alternate embodiments of the force modulation system 10 of the present invention with a third force member 80 positioned against the blade cap 30 so as to exert a third force in the second direction 44A of the blade cap 30 opposite to the first force. In this embodiment, the first force member 70 and the third force member 80 are opposite each other to avoid excessive force back and forth in the second direction 44 and opposite second direction 44A. Instead of a hard stop against the drill bit, the blade cap 30 can reduce excessive force in both the second direction 44 and the opposite second direction 44A of the blade cap 30 relative to the drill bit. The same back and forth avoidance of excessive force from depth of cut in the one direction relative to the drill bit can be achieved with the force modulation system 10 of the present invention. The first force member 60 and the third force member 80 provide a back and forth avoidance of excessive force from impacts at the junction of different rock materials in the rock formation. The force modulation system 10 can preserve the working life of the cutters 20 by avoiding excessive forces in multiple directions. FIG. 2 shows an embodiment of the system 10 with a first force member 60 and a third force member 80 and without a second force member 70. The cap retention means 50 can exert the first force in the first direction 42 without the second force member.

FIGS. 4-5 further show embodiments with the third force member 80 not completely cumulative with either the cap retention means 50 in the first direction 42 or the first force member 60 in the second direction 44. The third force in the opposite second direction 44A is still offset from the first direction 42. The third force has a vector of force in the first direction 42 and another vector of force in the opposite second direction 44A.

In the present invention, there are at least two directions, the first direction 42 and the second direction 44. The opposite second direction 44A is optional. However, the present invention includes more than a perfect separation of forces into a single direction. The cap retention force, the first force and the second force can be cooperative in the first direction 42 and the second direction 44, as long as there are multiple directions.

FIGS. 6-10 show embodiments of the third force member 180, the first force member 160, and the second force member 170 as being made integral with each other. The second force member 170 is between the first force member 160 and the third force member 180. Whether an elastomeric insert, a plastic insert, metal mesh, composite elastomeric insert, or other known mechanical device to exert force on the blade cap 30 relative to the drill bit 15, the first force member 160 can be made integral with the second force member 170 and third force member 180. As an elastomeric or rubber insert, there can be a first spring portion 162, a second spring portion 172, and a third spring portion 182. The second spring portion 172 is between the first spring portion 162 and the third spring portion 182. The first spring portion 162 and the third spring portion 182 face opposite directions, corresponding to the second direction 44 for the first spring portion 162 and the opposite second direction 44A for the third spring portion 182. The offset angled relationship as orthogonal for the first direction 42 and second direction 44 and between the first direction 42 and the opposite second direction 44A are also shown in FIGS. 3, 7, and 10, even with the first force member 160, the second force member 170, and the third force member 180 being unitary.

Alternate embodiments of the force modulation system 10 include the blade cap 30 in FIGS. 6-10 with the cap body 32 as a wedge 130. In this embodiment, the holding end 36 is an outer perimeter 136 of the wedge 130, and the plurality of cap sides 38 is comprised of two flange portions 138 extending from the outer perimeter 136 to the anchor end 34. The cap retention means 50 fixedly engaged the two flange portions 138 as the at least two cap sides of the blade cap 30. The two flange portions 138 are opposite each other. A section of the drill bit body extends between the two flange portions 138. FIGS. 6, 7, and 10 further show the anchor end 34 being comprised of a pivot point 134, wherein the cap retention means 50 is a retention pin 150 inserted through the two flange portions 138 at the anchor end 34. The retention pin 150 also inserts through the section of the drill bit body extended between the two flange portions 138. The retention pin 150 sets the first direction 42 as radial from the pivot point 134, while the second direction 44 and the opposite second direction 44A are tangent to the first direction 42. In this embodiment, the offset angled relationship between the first direction 42 and the second direction 44 is orthogonal as radial and tangent to the pivot point 134.

For the embodiment of the wedge 130, the force modulation system 10 includes the third force member 180, the first force member 160, and the second force member 170 being made integral with each other. As in FIGS. 6-10, the second force member 170 is between the first force member 160 and the third force member 180. As an elastomeric or rubber insert, there can be a first spring portion 162, a second spring portion 172, and a third spring portion 182. The second spring portion 172 is between the first spring portion 162 and the third spring portion 182. The second spring portion 172 is placed between the drill bit and the outer perimeter 136. The first spring portion 162 fits inside one of the two flange portions 138, while the third spring portion 182 fits inside the remaining one of the two flange portions 138.

The embodiment with the wedge 130 maintains the offset relationship of the first direction 42 and second direction 44 and the orthogonal relationship of the first direction 42 and the opposite second direction 44A. The first spring portion 162 and the third spring portion 182 face opposite directions on the two flange portions 138, corresponding to the second direction 44 for the first spring portion 162 and the opposite second direction 44A for the third spring portion 182. The orthogonal relationship of the first direction 42 as radial and second direction 44 as tangent and between the first direction 42 as radial and the opposite second direction 44A as tangent are also shown in FIGS. 3, 7, and 10, even with the first force member 160, the second force member 170, and the third force member 180 being unitary. The second force member 170 still avoids excessive force from depth of cut with the radial first direction 42 of the second force. The first force member 160 and the third force member 180 add the avoidance of excessive force from impact with joints between different rock materials with the tangent second direction 44 of the first force and the tangent opposite second direction 44A of the third force. Either the first force or the third force is exerted, depending on the direction of the impact force to be avoided.

The present invention is a force modulation system for a drill bit. The system forms a variable cutting profile as the fixed cutters can have different contact on a rock formation while drilling. The cutting profile changes to avoid excessive force that would damage the fixed cutters. The force modulation system has particular usefulness for fixed cutters on the bit blade or shoulder of the drill bit. These cutters on the bit blade or shoulder of the drill bit typically drill the rock formation at junctions between different types of rock materials. There is a higher risk of excessive force to damage cutters at these joints. There is excessive force from depth of cut and impact from the different types of rock materials. The force modulation of the system can avoid these excessive forces from different directions.

The present invention is a multi-directional force modulation system. Instead of being restricted to the one direction of in and out of the drill bit cavity, corresponding only to depth of cut, the system can also move cutters in another direction back and forth within the drill bit cavity. The cutting profile is variable in more than one dimension. In some embodiments, the first direction is set by a cap retention member relative to the drill bit, and the second direction is set by the first force member offset from the cap retention member. In other embodiments, there is a second force member that is set in the first direction to back up the cap retention member.

The first direction and the second direction are angled offset from each other. The first and second directions can be orthogonal to each other. In alternate embodiments, forces are not completely aligned in a single direction. The first force is not in the first direction or the second direction. At least a vector of the first force must be in the second direction, not all of the first force. When the blade cap is a wedge, the first direction can be radial from a pivot point, while the second direction can be tangent to the first direction. There can also be an opposite second direction tangent to the first direction. The first force member and the third force member add the avoidance of excessive force from impact with joints between different rock materials with the tangent second direction of the first force and the tangent opposite second direction of the third force. Either the first force or the third force is exerted, depending on the direction of the impact force to be avoided. For prior art variable cutting profiles, there is no avoidance of excessive forces from more than one direction, and the avoidance only applies to excessive force from depth of cut. The variable cutting profiles of the prior art only compensate for a particular excessive force to avoid damage, instead of the different excessive forces from different directions. In the prior art systems, the one direction must be selected according to placement of the fixed cutter on the part of the drill bit. The multi-directional force modulation system can now avoid excessive force from more than one direction. The force modulation system of the present invention can be used for cutters in different parts of the drill bit, including the shoulder. The drill bit has an extended working life by avoid more excessive force on cutters than other prior art systems.

The foregoing disclosure and description of the invention is illustrative and explanatory thereof. Various changes in the details of the illustrated structures, construction and method can be made without departing from the true spirit of the invention.

We claim:

1. A force modulation system for a drill bit, comprising:

a cutter being comprised of a cutter body having a cutting end, and a cutting surface made integral with said cutter body at said cutting end;

a blade cap being comprised of a cap body having an anchor end, a holding end opposite said anchor end, a plurality of cap sides between said anchor end and said holding end, and a cap opening at said holding end, said cutter body being in removable slide fit engagement with said cap opening;

a cap retention means fixedly engaged to at least two cap sides so as to exert a cap retention force in a first direction of said blade cap;

a first force member positioned against said cap body so as to exert a first force in a second direction of said cap body, said second direction being angled offset to said first direction;

a second force member positioned against said cap body so as to exert a second force in said first direction of said cap body; and a third force member positioned against said cap body so as to exert a third force in said second direction of said cap body opposite said first force member, wherein said first direction is a direction of movement of the cap body and said cutter relative to the drill bit, and wherein said second direction is another direction of movement of said holder and said cutter relative to the drill bit, and wherein said cap body is a wedge, said holding end being an outer perimeter of said wedge, said cutter extending outward from said outer perimeter, said cap sides being comprised of two flange portions extending from said outer perimeter to said anchor end, said cap retention means being fixedly engaged to said two flange portions.

2. The force modulation system, according to claim 1, wherein said cutter is removably engaged with said blade cap, said cutting surface being extended from said blade cap so as to cut a rock formation.

3. The force modulation system, according to claim 1, wherein said blade cap is comprised of another cap opening, further comprising:

another cutter having another cutter body being in removable slide fit engagement with said another cap opening.

4. The force modulation system, according to claim 1, wherein said second direction is orthogonal to said first direction.

5. The force modulation system, according to claim 1, wherein said cap retention force is greater than said second force.

6. The force modulation system, according to claim 1, wherein said first force member is made integral with said second force member and said third force member.

7. The force modulation system, according to claim 6, wherein said third force member is comprised of a first spring portion, a second spring portion, and a third spring portion between said first spring portion and said second spring portion, said second force member being comprised of said second spring portion, said third force member being comprised of said third spring portion.

8. The force modulation system, according to claim 1, wherein said anchor end is comprised of a pivot point on said two flange portions, and wherein said cap retention means is comprised of a retention pin inserted through said two flange portions at said anchor end.

9. The force modulation system, according to claim 8, wherein said first direction is radial from said pivot point, and wherein said second direction is tangent to said first direction.

* * * * *